US010380943B2

(12) United States Patent
Choi et al.

(10) Patent No.: US 10,380,943 B2
(45) Date of Patent: Aug. 13, 2019

(54) ORGANIC LIGHT EMITTING DISPLAY DEVICE INCLUDING A SENSING UNIT TO MEASURE AT LEAST ONE OF CURRENT AND VOLTAGE, AND METHOD OF DRIVING THE SAME

(71) Applicant: Samsung Display Co., Ltd., Yongin-si (KR)

(72) Inventors: Sang Moo Choi, Yongin-si (KR); Ji Hyun Ka, Yongin-si (KR); Won Kyu Kwak, Yongin-si (KR); Jin Jeon, Yongin-si (KR); Jin Tae Jeong, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/907,144

(22) Filed: Feb. 27, 2018

(65) Prior Publication Data

US 2019/0057650 A1 Feb. 21, 2019

(30) Foreign Application Priority Data

Aug. 18, 2017 (KR) ..... 10-2017-0104918

(51) Int. Cl.
*G09G 5/10* (2006.01)
*G09G 3/3233* (2016.01)

(52) U.S. Cl.
CPC ..... *G09G 3/3233* (2013.01); *G09G 2310/08* (2013.01); *G09G 2320/0247* (2013.01); *G09G 2330/12* (2013.01)

(58) Field of Classification Search
None
See application file for complete search history.

(56) References Cited

U.S. PATENT DOCUMENTS 7,414,599 B2 8/2008 Chung et al.
2007/0279343 A1* 12/2007 Kim ..... G09G 3/2007 345/77

(Continued)

FOREIGN PATENT DOCUMENTS

KR 10-0560780 3/2006
KR 10-0882694 2/2009

(Continued)

*Primary Examiner* — Lunyi Lao
*Assistant Examiner* — Kirk W Hermann
(74) *Attorney, Agent, or Firm* — H.C. Park & Associates, PLC

(57) ABSTRACT

An organic light emitting display device includes pixels connected to scan lines, data lines, and emission control lines to emit light components in response to amounts of current that flow from a first driving power source to a second driving power source, a sensing unit connected between the first or second driving power source and the pixels to measure to at least one of current and voltage, a controller to sense a control signal in response to at least one of the current and the voltage measured by the sensing unit, a timing controller to supply a plurality of emission start signals with different widths in a one frame period in response to the control signal when the organic light emitting display device is driven at a low frequency, and an emission driver to supply emission control signals to the emission control lines in response to the emission start signals.

10 Claims, 8 Drawing Sheets

(56) References Cited

U.S. PATENT DOCUMENTS

| | | | | |
|---|---|---|---|---|
| 2008/0266214 | A1* | 10/2008 | Naugler | G09G 3/3225 345/76 |
| 2011/0084955 | A1 | 4/2011 | Kim | |
| 2015/0103062 | A1* | 4/2015 | Kwon | G09G 3/3291 345/212 |
| 2015/0255523 | A1* | 9/2015 | Her | H01L 27/3262 345/76 |
| 2016/0078824 | A1* | 3/2016 | Meador | G09G 3/3433 345/212 |
| 2016/0189620 | A1* | 6/2016 | Park | G09G 3/3258 345/690 |
| 2017/0124958 | A1 | 5/2017 | Pyo et al. | |
| 2017/0186372 | A1* | 6/2017 | Yanase | G09G 3/3233 |

FOREIGN PATENT DOCUMENTS

| | | |
|---|---|---|
| KR | 10-1101070 | 12/2011 |
| KR | 10-1606766 | 4/2016 |

* cited by examiner

ORGANIC LIGHT EMITTING DISPLAY DEVICE INCLUDING A SENSING UNIT TO MEASURE AT LEAST ONE OF CURRENT AND VOLTAGE, AND METHOD OF DRIVING THE SAME

CROSS-REFERENCE TO RELATED APPLICATION

This application claims priority from and the benefit of Korean Patent Application No. 10-2017-0104918, filed on Aug. 18, 2017, which is hereby incorporated by reference for all purposes as if fully set forth herein.

BACKGROUND

Field

Exemplary embodiments relate to an organic light emitting display device and a method of driving the same.

Discussion of the Background

With the development of information technology, display devices have become important as connection mediums between users and information. In line with this, uses of display devices such as liquid crystal display devices and organic light emitting display devices are increasing.

Among such display devices, an organic light emitting display device displays an image by using organic light emitting diodes (OLED) that generate light components by re-combination of electrons and holes. The organic light emitting display device has a high response speed and low power consumption.

The organic light emitting display device includes pixels connected to data lines and scan lines. Each of the pixels commonly includes an OLED and a driving transistor for controlling an amount of current that flows to the OLED. The driving transistor controls an amount of current that flows from a first driving power source to a second driving power source via the OLED in response to a data signal. At this time, the OLED generates light with predetermined brightness in response to an amount of current from the driving transistor.

Recently, a method of driving organic light emitting display devices at both a high frequency and a low frequency has been developed. When the organic light emitting display device is driven at the low frequency (for example, less than 60 Hz), power consumption may be minimized. When the organic light emitting display device is driven at the high frequency (for example, no less than 60 Hz), a moving picture may be clearly displayed.

However, when the organic light emitting display device is driven at the low frequency, a one frame period is set to be large so that a difference in brightness between frames is recognized and that a flicker phenomenon may occur.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the invention may provide an organic light emitting display device that prevents or reduces a flicker phenomenon from occurring.

Exemplary embodiments of the invention may also provide a method of driving the organic light emitting display device to reduce or prevent a flicker phenomenon from occurring.

Additional aspects will be set forth in the detailed description which follows, and, in part, will be apparent from the disclosure, or may be learned by practice of the inventive concept.

An exemplary embodiment discloses an organic light emitting display device that includes pixels connected to scan lines, data lines, and emission control lines and configured to emit light components in response to amounts of current that flow from a first driving power source to a second driving power source, a sensing unit connected between the first driving power source and the pixels or between the second driving power source and the pixels and configured to measure to at least one of current and voltage, a controller configured to generate a control signal in response to at least one of the current and the voltage measured by the sensing unit, a timing controller configured to supply a plurality of emission start signals with different widths in a one frame period in response to the control signal when the organic light emitting display device is driven at a low frequency, and an emission driver configured to supply emission control signals to the emission control lines in response to the emission start signals.

When the organic light emitting display device is driven at the low frequency, the one frame period may be divided into a plurality of sub-periods with the same width and emission periods of the pixels in the sub-periods are set to be different from each other in response to the widths of the emission start signals.

The widths of the emission start signals may be set so that the emission periods of the pixels increase from the first sub-period toward the last sub-period.

The organic light emitting display device may further include an ammeter configured to measure the amounts of the currents.

The controller may include a comparator configured to accumulate the amounts of the currents from the sensing unit in the emission period of the first sub-period in the one frame period, to store the accumulated amounts of the currents as a reference value, and to generate the control signal when the reference value is equal to the amounts of the currents measured by the sensing unit in the other sub-periods and a storage unit configured to store the reference value.

The emission period of the first sub-period may be previously set to be no more than 80% of the first sub-period and the emission periods of the other sub-periods are set in response to the control signal.

The sensing unit may include a sensing resistor.

The controller may include a converter configured to convert the voltage values from the sensing resistor into the current values, a comparator configured to accumulate the amounts of the currents from the converter in the emission period of the first sub-period in the one frame period, to store the accumulated amounts of the currents as a reference value, and to generate the control signal when the reference value is equal to the amounts of the currents supplied from the converter in the other sub-periods, and a storage unit configured to store the reference value.

The emission period of the first sub-period may be previously set to be no more than 80% of the first sub-period and the emission periods of the other sub-periods are set in response to the control signal.

A method of driving an organic light emitting display device so that a one frame period is divided into a plurality of sub-periods according to an exemplary embodiment of the present invention includes accumulating amounts of current that flow to pixels in an emission period of a first sub-period and controlling emission periods of the pixels so that the amounts of current that flow to the pixels in remaining sub-periods excluding the first sub-period are the same as the amounts of the current accumulated in the first sub-period.

When the first sub-period is set as 100%, the emission period of the first sub-period may be set to be no more than 80%.

The emission periods of the pixels may be set to be larger from the first sub-period toward the last sub-period.

The pixels may maintain data signals supplied in the first sub-period in the remaining sub-periods.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
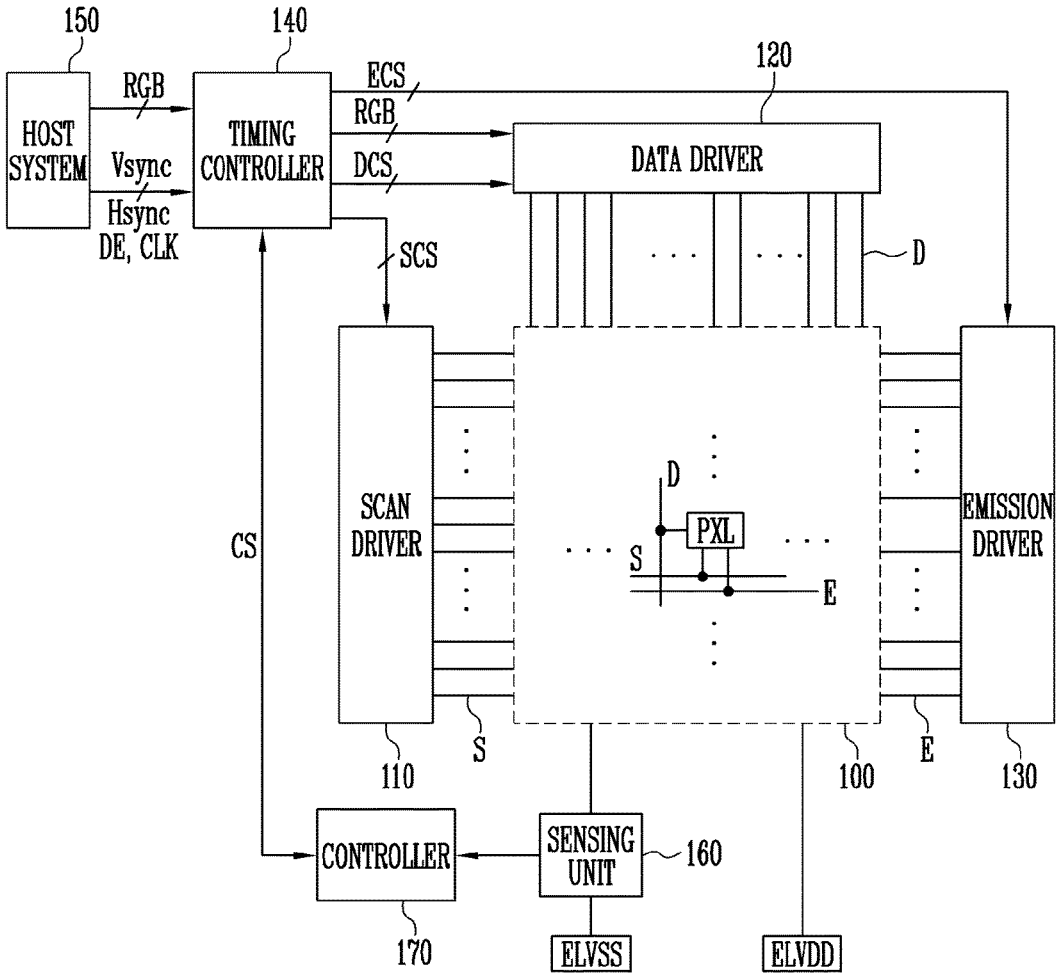
FIG. 1 is a view illustrating an organic light emitting display device according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a view illustrating an organic light emitting display device according to an exemplary embodiment of the invention.

Referring to FIG. 1, the organic light emitting display device according to the exemplary embodiment includes a pixel unit 100, a scan driver 110, a data driver 120, an emission driver 130, a timing controller 140, a host system 150, a sensing unit 160, and a controller 170.

The host system 150 supplies image data RGB to the timing controller 140 through a predetermined interface. In addition, the host system 150 supplies timing signals such as a vertical synchronizing signal Vsync, a horizontal synchronizing signal Hsync, a data enable signal DE, and a clock signal CLK to the timing controller 140.

The timing controller 140 generates a scan driving control signal SCS, a data driving control signal DCS, and an emission driving control signal ECS based on the timing signals such as the image data RGB, the vertical synchronizing signal Vsync, the horizontal synchronizing signal Hsync, the data enable signal DE, and the clock signal CLK that are output from the host system 150. The scan driving control signal SCS generated by the timing controller 140 is supplied to the scan driver 110, the data driving control signal DCS is supplied to the data driver 120, and the emission driving control signal ECS is supplied to the emission driver 130. The timing controller 140 realigns the data RGB supplied from the outside and supplies the realigned data RGB to the data driver 120.

In addition, the timing controller 140 controls supply timing of an emission start signal supplied to the emission driver 130 in response to a control signal CS supplied from the controller 170 when the organic light emitting display device is driven at a low frequency. For example, the timing controller 140 may supply a plurality of emission start signals with different widths to the emission driver 130 in response to the control signal CS in a one frame period, which will be described later.

The scan driving control signal SCS includes a scan start signal and clock signals. The scan start signal controls first timings of scan signals. The clock signals are used for shifting the scan start signal.

The data driving control signal DCS includes a source start signal and clock signals. The source start signal controls a data sampling start point of time. The clock signals are used for controlling sampling operations.

The emission driving control signal ECS includes the emission start signal and the clock signals. The emission start signal controls widths and supply timings of emission control signals. The clock signals are used for shifting the emission start signal.

The scan driver 110 supplies the scan signals to scan lines S in response to the scan driving control signal SCS. For example, the scan driver 110 may sequentially supply the scan signals to the scan lines S. When the scan signals are sequentially supplied to the scan lines S, pixels PXL are selected in units of horizontal lines. For this purpose, the scan signals are set to have gate on voltages so that transistors included in the pixels PXL may be turned on.

The data driver 120 supplies data signals to data lines D in response to the data driving control signal DCS. The data signals supplied to the data lines D are supplied to the pixels PXL selected by the scan signals. For this purpose, the data driver 120 may supply the data signals to the data lines D in synchronization with the scan signals.

The emission driver 130 supplies the emission control signals to emission control lines E in response to the emission driving control signal ECS. For example, the emission driver 130 may sequentially supply the emission control signals to the emission control lines E. When the emission control signals are sequentially supplied to the emission control lines E, the pixels PXL do not emit light components in units of horizontal lines. For this purpose, the emission control signals are set to have gate off voltages so that the transistors included in the pixels PXL may be turned off.

In addition, an emission control signal supplied to an ith (i is a natural number) emission control line Ei may overlap a scan signal supplied to an ith scan line Si. Then, in a period in which data signals are supplied to pixels PXL positioned in an ith horizontal line, the pixels PXL positioned in the ith horizontal line are set to be in a non-emission state so that it is possible to prevent undesired light components from being generated by the pixels PXL.

In addition, the emission driver 130 respectively supplies the plurality of emission control signals to the emission control lines E in response to control of the timing controller 140 in one frame period when the organic light emitting display device is driven at the low frequency. Here, the plurality of emission control signals respectively supplied to the emission control lines E in the one frame period are set to have different widths, which will be described in detail later.

On the other hand, in FIG. 1, the scan driver 110 and the emission driver 130 are illustrated as separate drivers. However, exemplary embodiments are not limited thereto. For example, the scan driver 110 and the emission driver 130 may be formed of one driver. The scan driver 110 and/or the emission driver 130 may be mounted on a substrate through a thin film process. In addition, the scan driver 110 and/or the emission driver 130 may be positioned at both sides with the pixel unit 100 interposed.

The pixel unit 100 includes the pixels PXL positioned to be connected to the data lines D, the scan lines S, and the emission control lines E. The pixels PXL receive a first driving power source ELVDD and a second driving power source ELVSS from the outside.

The pixels PXL are selected when the scan signals are supplied to the scan lines S connected thereto and receive the data signals from the data lines D. The data signals that the pixels PXL receives controls the amounts of current that flow from the first driving power source ELVDD to the second driving power source ELVSS via organic light emitting diodes (OLED) (not shown). At this time, the OLEDs generate light components with predetermined brightness components in response to the amounts of the current the OLED receives. In addition, the first driving power source ELVDD is set to have a voltage higher than that of the second driving power source ELVSS.

On the other hand, in FIG. 1, it is illustrated that each of the pixels PXL is connected to one scan line S, one data line D, and one emission control line E. However, exemplary embodiments are not limited thereto. That is, in response to a circuit structure of each of the pixels PXL, the signal lines S, D, and E connected to the pixels PXL may set vary. In addition, according to the exemplary embodiment, the pixels PXL may be implemented by currently known various circuits.

The sensing unit 160 is connected between the pixels PXL and the second driving power source ELVSS. The sensing unit 160 senses a current and/or a voltage between the pixels PXL and the second driving power source ELVSS.

The controller 170 supplies the control signal CS to the timing controller 140 in response to the current and/or the voltage sensed by the sensing unit 160. Here, the controller 170 supplies the control signal CS only when the organic light emitting display device is driven at the low frequency and does not supply the control signal CS when the organic light emitting display device is driven at a high frequency.

That is, the organic light emitting display device may be driven at the high frequency by various known methods. Detailed description thereof will not be given.

In addition, in FIG. 1, the controller 170 is illustrated as being separate from the timing controller 140. However, exemplary embodiments are not limited thereto. For example, the controller 170 may be included in the timing controller 140.

Figure 2A:
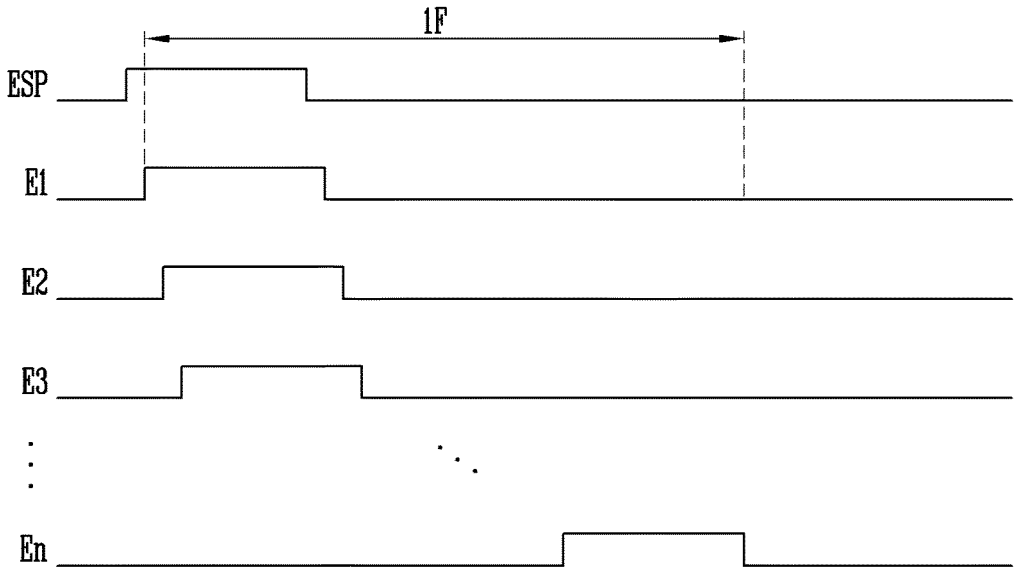
FIGS. 2A and 2B are views illustrating schematic operation processes of the emission driver of FIG. 1.
Figure 2B:
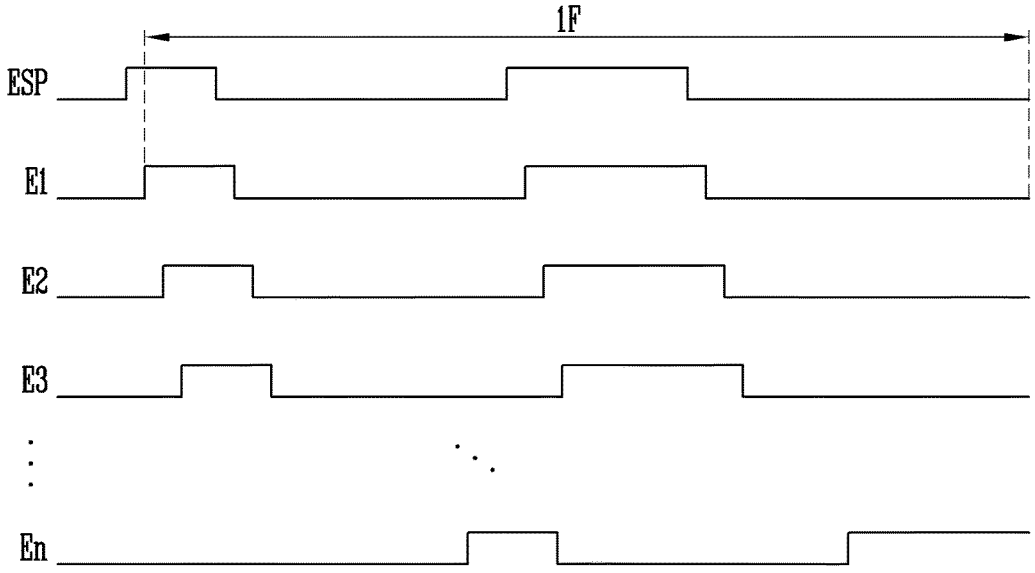

FIGS. 2A and 2B are views illustrating schematic operation processes of the emission driver of FIG. 1.

Referring to FIGS. 2A and 2B, the emission driver 130 according to the exemplary embodiment sequentially supplies the emission control signals to the emission control lines E1 through En in response to the emission start signal ESP. Here, widths of the emission control signals supplied to the emission control lines E1 through En and the number of times of the emission control signals are supplied are controlled by the emission start signal ESP.

For example, when the emission start signal ESP is supplied once in a one frame 1F period, the emission control signals are respectively supplied to the emission control lines E1 through En once. When the emission start signal ESP is supplied twice in the one frame 1F period, the emission control signals are respectively supplied to the emission control lines E1 through En twice.

In addition, the widths of the emission control signals respectively supplied to the emission control lines E1 through En are set to be the same as or similar to a width of the emission start signal ESP. Therefore, the widths of the emission control signals and the number of times the emission control signals are supplied to the emission control lines E1 through En may be controlled by controlling the width of the emission start signal ESP and number of times the emission start signal ESP is supplied in the one frame 1F period.

As described above, the emission driver 130, according to the exemplary embodiment, controls the widths of the emission control signals and number of times the emission control signals are supplied in response to the emission start signal ESP. The emission driver 130 may be implemented by various known circuits.

Figure 3:
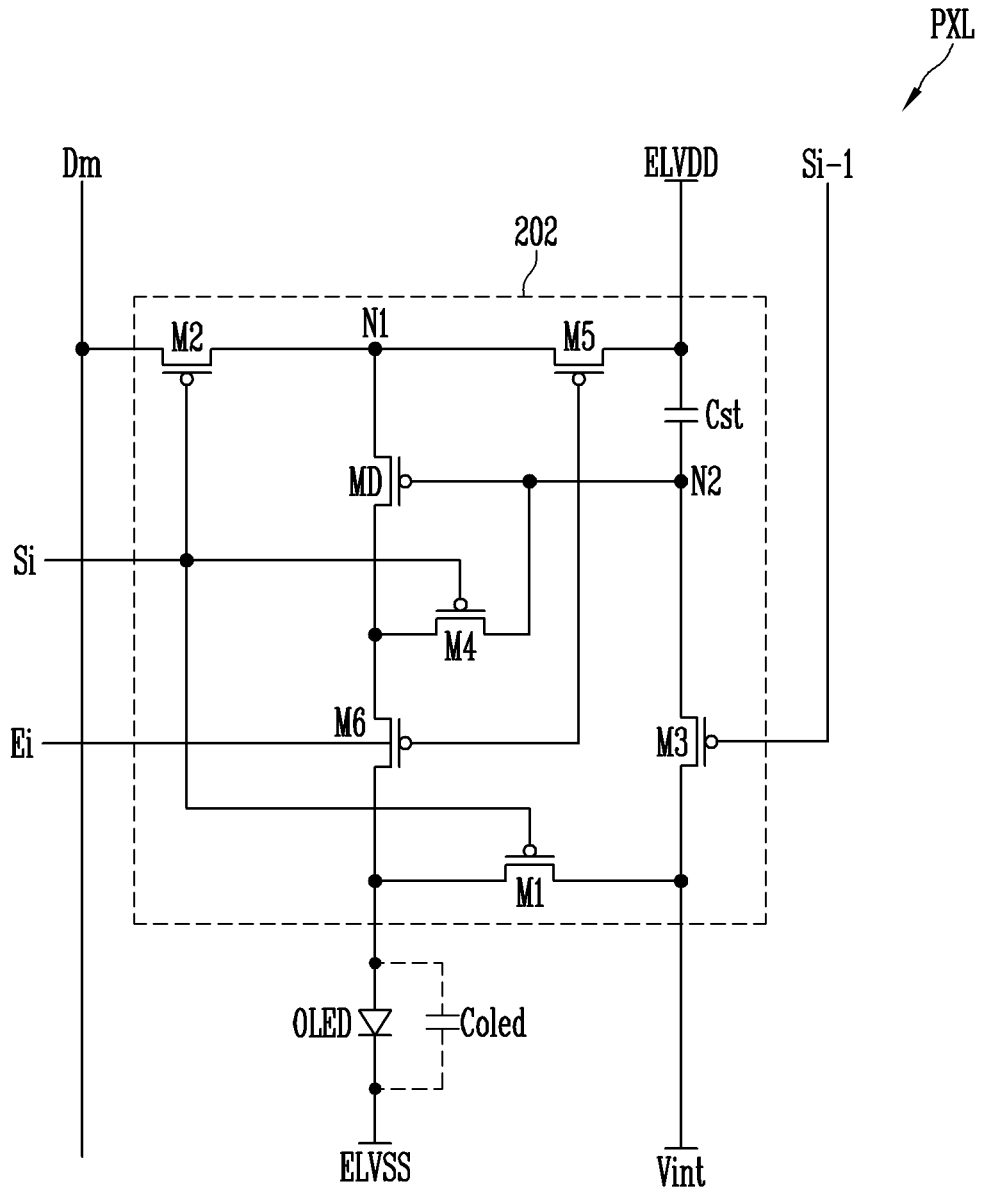
FIG. 3 is a view illustrating an exemplary embodiment of the pixel of FIG. 1.

FIG. 3 is a view illustrating an exemplary embodiment of the pixel of FIG. 1. In FIG. 3, for convenience sake, the pixel PXL positioned in the ith horizontal line will be illustrated.

Referring to FIG. 3, the pixel PXL, according to the exemplary embodiment, includes an OLED and a pixel circuit 202 for controlling an amount of current supplied to the OLED.

An anode electrode of the OLED is connected to the pixel circuit 202 and a cathode electrode thereof is connected to the second driving power source ELVSS. The OLED generates light with predetermined brightness in response to the amount of the current supplied from the pixel circuit 202. On the other hand, the cathode electrode of the OLED is connected to the second driving power source ELVSS via the sensing unit 160. However, in FIG. 3, for convenience sake, it is illustrated that the cathode electrode of the OLED is directly connected to the second driving power source ELVSS.

The pixel circuit 202 controls the amount of the current supplied to the OLED in response to the data signal supplied from the data line Dm. For this purpose, the pixel circuit 202 includes a driving transistor MD, first through sixth transistors M1 through M6, and a storage capacitor Cst.

A first electrode of the driving transistor MD is connected to a first node N1 and a second electrode thereof is connected to a first electrode of the sixth transistor M6. A gate electrode of the driving transistor MD is connected to a second node N2. The driving transistor MD controls the amount of the current that flows from the first driving power source ELVDD to the second driving power source ELVSS via the OLED in response to a voltage charged in the storage capacitor Cst.

The first transistor M1 is connected between the anode electrode of the OLED and a first power source Vint. A gate electrode of the first transistor M1 is connected to the ith scan line Si. The first transistor M1 is turned on when the scan signal is supplied to the ith scan line Si and electrically connects the anode electrode of the OLED and the first power source Vint.

In addition, the gate electrode of the first transistor M1 may receive one of the scan signals that overlap the emission control signal supplied to the ith emission control line Ei. For example, when the emission control signal supplied to the ith emission control line Ei overlaps the scan signals supplied to the (i−1)th scan line Si−1, the ith scan line Si, and the (i+1)th scan line Si+1, the gate electrode of the first transistor M1 may be electrically connected to one of the (i−1)th scan line Si−1, the ith scan line Si, and the (i+1)th scan line Si+1.

The second transistor M2 is connected between the data line Dm and the first node N1. A gate electrode of the second transistor M2 is connected to the ith scan line Si. The second transistor M2 is turned on when the scan signal is supplied to the ith scan line Si and electrically connects the data line Dm and the first node N1.

The third transistor M3 is connected between the second node N2 and the first power source Vint. A gate electrode of the third transistor M3 is connected to the (i−1)th scan line Si−1. The third transistor M3 is turned on when the scan signal is supplied to the (i−1)th scan line Si−1 and supplies a voltage of the first power source Vint to the first power source Vint. Here, the voltage of the first power source Vint is set to be lower than that of the data signal supplied to the data line Dm.

The fourth transistor M4 is connected between the second electrode of driving transistor MD and the second node N2. The gate electrode of the fourth transistor M4 is connected to the ith scan line Si. The fourth transistor M4 is turned on when the scan signal is supplied to the ith scan line Si and diode-connects the driving transistor MD.

The fifth transistor M5 is connected between the first driving power source ELVDD and the first node N1. A gate electrode of the fifth transistor M5 is connected to the ith emission control line Ei. The fifth transistor M5 is turned off when the emission control signal is supplied to the ith emission control line Ei and is turned on in the other case. When the fifth transistor M5 is turned on, a voltage of the first driving power source ELVDD is supplied to the first node N1.

The sixth transistor M6 is connected between the second electrode of the driving transistor MD and the anode electrode of the OLED. A gate electrode of the sixth transistor M6 is connected to the ith emission control line Ei. The sixth transistor M6 is turned off when the emission control signal is supplied to the ith emission control line Ei and is turned on in the other case. When the sixth transistor M6 is turned on, the second electrode of the driving transistor MD and the anode electrode of the OLED are electrically connected to each other.

The storage capacitor Cst is connected between the first driving power source ELVDD and the second node N2. The storage capacitor Cst charges the data signal and a voltage corresponding to a threshold voltage of the driving transistor MD.

Figure 4:
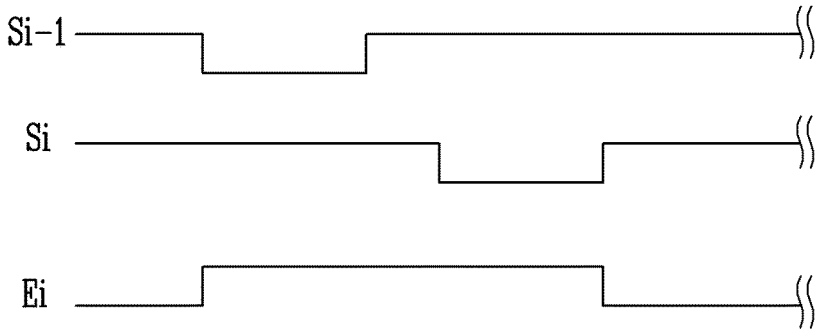
FIG. 4 is a waveform diagram illustrating an exemplary embodiment of a method of driving the pixel of FIG. 3.

FIG. 4 is a waveform diagram illustrating an exemplary embodiment of a method of driving the pixel of FIG. 3.

Referring to FIG. 4, first, when the emission control signal is supplied to the ith emission control line Ei, the fifth transistor M5 and the sixth transistor M6 are turned off. When the fifth transistor M5 is turned off, the first driving power source ELVDD and the first node N1 are electrically isolated from each other. When the sixth transistor M6 is turned off, the driving transistor MD and the OLED are electrically isolated from each other. Therefore, in a period in which the emission control signal is supplied, the pixel PXL is set to be in a non-emission state.

Then, the scan signal is supplied to the (i−1)th scan line Si−1. When the scan signal is supplied to the (i−1)th scan line Si−1, the third transistor M3 is turned on. When the third transistor M3 is turned on, the voltage of the first power source Vint is supplied to the second node N2.

After the voltage of the first power source Vint is supplied to the second node N2, the scan signal is supplied to the ith scan line Si. When the scan signal is supplied to the ith scan line Si, the first transistor M1, the second transistor M2, and the fourth transistor M4 are turned on.

When the first transistor M1 is turned on, the voltage of the first power source Vint is supplied to the anode electrode of the OLED. When the voltage of the first power source Vint is supplied to the anode electrode of the OLED, an organic capacitor Coled equivalently formed in the OLED is discharged so that black display ability increases.

When the fourth transistor M4 is turned on, the driving transistor MD is diode-connected. When the second transistor M2 is turned on, the data signal from the data line Dm is supplied to the first node N1. At this time, since the second node N2 is set to have the voltage of the first power source Vint lower than that of the data signal, the driving transistor MD is turned on.

When the driving transistor MD is turned on, the data signal supplied to the first node N1 is supplied to the second node N2 via the diode-connected driving transistor MD. At this time, the second node N2 is set as the data signal and the voltage corresponding to the threshold voltage of the driving transistor MD. The storage capacitor Cst stores the voltage applied to the second node N2.

After the data signal and the voltage corresponding to the threshold voltage of the driving transistor MD are charged in the storage capacitor Cst, supply of the emission control signal to the ith emission control line Ei stops. When the supply of the emission control signal to the ith emission control line Ei stops, the fifth transistor M5 and the sixth transistor M6 are turned on.

When the fifth transistor M5 is turned on, the first driving power source ELVDD and the first node N1 are electrically connected to each other. When the sixth transistor M6 is turned on, the driving transistor MD and the anode electrode of the OLED are electrically connected to each other. At this time, the driving transistor MD controls the amount of the current that flows from the first driving power source ELVDD to the second driving power source ELVSS via the OLED in response to the voltage applied to the second node N2.

On the other hand, as described above, emission time of the pixel PXL according to the exemplary embodiment is determined in response to the width of the emission control signal supplied to the ith emission control line Ei. For example, as the width of the emission control signal supplied to the ith emission control line Ei is set to be larger, the emission time of the pixel PXL is set to be smaller.

Figure 5A:
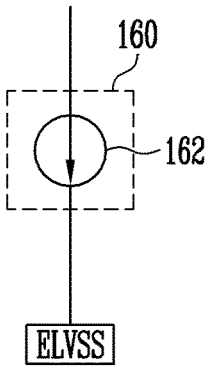
FIGS. 5A and 5B are views illustrating an exemplary embodiment of the sensing unit of FIG. 1.
Figure 5B:
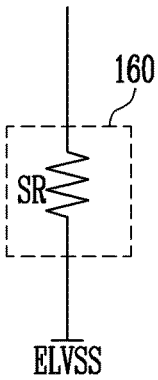

FIGS. 5A and 5B are views illustrating an exemplary embodiment of the sensing unit of FIG. 1.

Referring to FIG. 5A, the sensing unit 160 according to the exemplary embodiment includes an ammeter 162. The ammeter 162 is positioned between the second driving power source ELVSS and the pixels PXL and measures the amounts of the current supplied from the pixels PXL to the second driving power source ELVSS. The amounts of the current measured by the ammeter 162 are supplied to the controller 170.

Referring to FIG. 5B, the sensing unit 160 according to another exemplary embodiment includes a sensing resistor SR. The sensing resistor SR is positioned between the second driving power source ELVSS and the pixels PXL. A voltage corresponding to the amounts of the current supplied from the pixels PXL to the second driving power source ELVSS is applied to the sensing resistor SR. The voltage applied to the sensing resistor SR is supplied to the controller 170.

Figure 6:
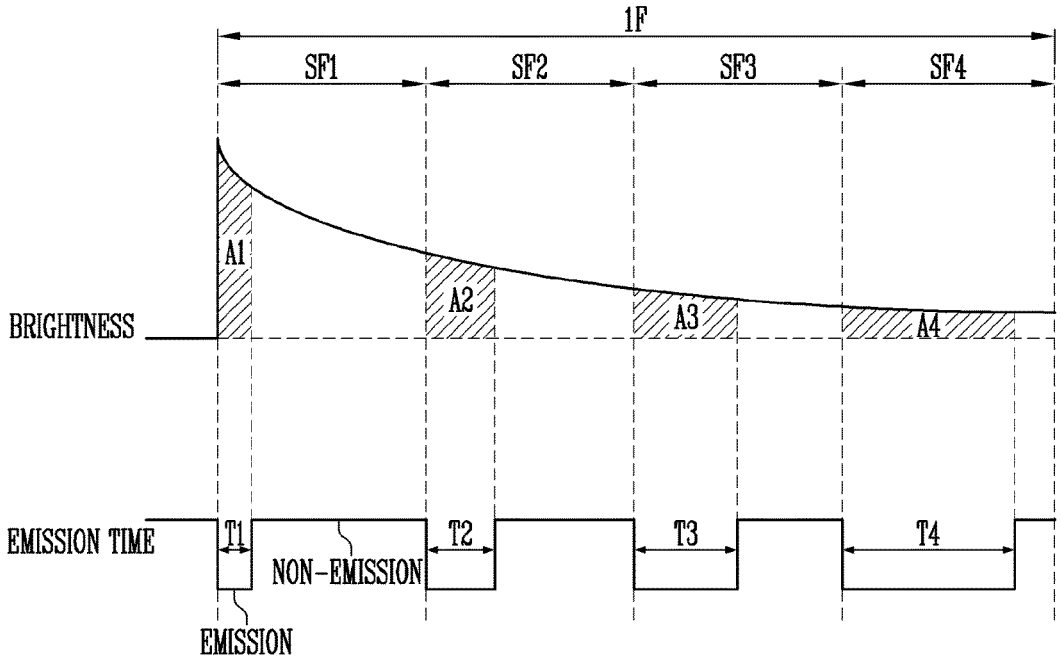
FIG. 6 is a view illustrating a one frame period when an organic light emitting display device is driven at a low frequency.

FIG. 6 is a view illustrating a one frame period when an organic light emitting display device is driven at a low frequency.

Referring to FIG. 6, when the organic light emitting display device is driven at the low frequency, the one frame 1F period is divided into a plurality of sub-periods SF1, SF2, SF3, and SF4. Here, the plurality of sub-periods SF1, SF2, SF3, and SF4 are set as the same period. In FIG. 6, for convenience sake, the one frame 1F period is illustrated as being divided into the four sub-periods SF1, SF2, SF3, and SF4. However, exemplary embodiments are not limited thereto. For example, the one frame 1F period may be divided into at least two sub-periods.

The brightness curve of FIG. 6 represents brightness when the pixel PXL emits light while maintaining a data signal in the one frame period. As illustrated in FIG. 6, the brightness of the pixel PXL is reduced with the lapse of time. That is, a voltage of the gate electrode of the driving transistor MD included in the pixel PXL is changed by leakage current so that the brightness of the pixel PXL is reduced with the lapse of time.

When the organic light emitting display device is driven at a high frequency, for example, 60 Hz, the one frame 1F period is set as 1/60 second. That is, when the organic light emitting display device is driven at the high frequency, the one frame 1F period is set to be small so that a change in brightness of the pixel PXL is not recognized by a user.

However, when the organic light emitting display device is driven at the low frequency, for example, 15 Hz, the one frame 1F period is set as 1/15 second. That is, when the organic light emitting display device is driven at the low frequency, the one frame 1F period is set to be large. Then, brightness of the former half of the one frame 1F period is different from that of the latter half of the one frame 1F period so that a difference in brightness between frames may be recognized by the user.

In order to solve the problem, according to the exemplary embodiment, the one frame 1F period is divided into the plurality of sub-periods SF1, SF2, SF3, and SF4 and the emission time of the pixel PXL is set to vary in each sub-period. That is, the emission time may be set to be larger from the first sub-period SF1 toward the fourth sub-period SF4. For this purpose, when the first sub-period SF1 is set to be 100%, the emission time of the first sub-period SF1 may be set to be no more than 80%.

In the first sub-period SF1, the pixel PXL emits light in a first period T1. In the second sub-period SF2, the pixel PXL may emit light in a second period T2 larger than the first period T1. In the third sub-period SF3, the pixel PXL emits light in a third period T3 larger than the second period T2. In the fourth sub-period SF4, the pixel PXL may emit light in a fourth period T4 larger than the third period T3.

That is, the emission time of the pixel PXL increases from the first sub-period SF1 toward the fourth sub-period SF4. When the emission time of the pixel PXL increases from the first sub-period SF1 toward the fourth sub-period SF4, it is possible to minimize the difference in brightness between the former half and the latter half of the one frame 1F period so that it is possible to improve display quality.

The brightness curve of the pixel PXL of FIG. 6 varies in accordance with a process deviation and a temperature characteristic. Therefore, it is necessary to additionally improve the display quality by controlling the pixel PXL to generate light components with the same brightness in the respective sub-periods SF1, SF2, SF3, and SF4 regardless of the process deviation and the temperature characteristic. According to the exemplary embodiment, for this purpose, the sensing unit 160 and the controller 170 are provided.

Figure 7A:
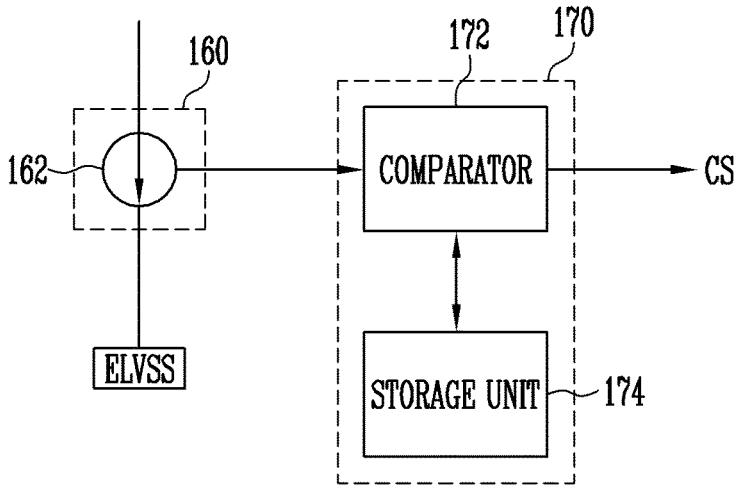
FIG. 7A is a view illustrating an exemplary embodiment of the controller of FIG. 1.

FIG. 7A is a view illustrating an embodiment of the controller of FIG. 1. In FIG. 7A, the sensing unit 160 is illustrated as including the ammeter 162.

Referring to FIG. 7A, the controller 170 according to the exemplary embodiment includes a comparator 172 and a storage unit 174.

In the first sub-period SF1, the comparator 172 receives current from the ammeter 162. The comparator 172 that receives the current from the ammeter 162 accumulates the current and stores the accumulated current value in the storage unit 174 as a reference value. Here, an amount of the accumulated current in the first sub-period SF1 may be described as an area of A1 of FIG. 6. On the other hand, the emission time, that is, the first period T1 of the first sub-period SF1 is previously set. For example, the first period T1 may be set to be no more than 80% of the first sub-period SF1.

Figure 8:
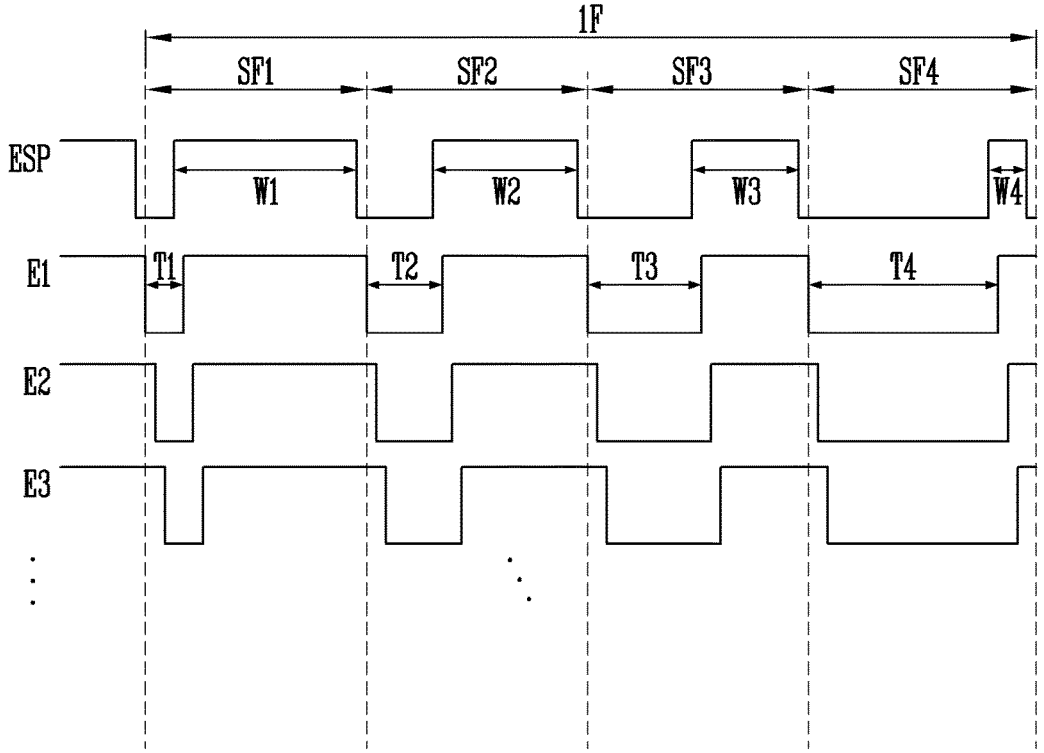
FIG. 8 is a view illustrating an exemplary embodiment of an emission start signal supplied in sub-periods.

The emission start signal ESP supplied from the timing controller 140 to the emission driver 130 in the first sub-period SF1 is set to have a first width W1 as illustrated in FIG. 8 so that the pixels PXL may emit light components in the first period T1. Here, the emission start signal ESP supplied in the first sub-period SF1 maintains a previously set value regardless of the temperature characteristic and the process deviation.

In the second sub-period SF2, the comparator 172 receives the current from the ammeter 162 and accumulates the current value. Then, the comparator 172 generates the control signal CS when the reference value stored in the storage unit 174 is equal to the accumulated current value and supplies the generated control signal CS to the timing controller 140. Here, an amount of the current accumulated in the second sub-period SF2 may be set as an area of A2 of FIG. 6. Then, the comparator 172 generates the control signal CS when the area of A2 is equal the area of A1 and supplies the generated control signal CS to the timing controller 140.

On the other hand, that the current value accumulated by the comparator 172 is equal to the reference value means that the amounts of the current that flow in the pixels PXL in the second sub-period SF2 are equal to the amounts of the current that flow in the pixels PXL in the first sub-period SF1 and that the brightness in the first sub-period SF1 is equal to that in the second sub-period SF2.

The timing controller 140 that receives the control signal CS supplies the emission start signal ESP to the emission driver 130. Here, the width of the emission start signal ESP is determined in response to a point of time at which the control signal CS is received.

Specifically, when it is assumed that the sub-periods SF1, SF2, SF3, and SF4 are set as 1 ms, the control signal CS may be supplied at a point of time of 0.3 ms of the second sub-period SF2. In this case, the timing controller 140 supplies the emission start signal ESP set to have a width of 0.7 ms to the emission driver 130.

In this case, the timing controller 140 supplies the emission start signal ESP set to have a second width W2 (see FIG. 8) smaller than the first width W1 to the emission driver 130. Then, the emission driver 130 supplies the emission control signals corresponding to the second width W2 (see FIG. 8) to the emission control lines E1 through En. On the other hand, the emission start signal ESP supplied in the second sub-period SF2 is set so that the pixel PXL emits light in the second period T2.

Here, the second period T2 is set to be larger than the first period T1 and is set so that the pixel PXL emits light with the same brightness as in the first period T1. That is, the second period T2 is set so that the same current as in the first period T1 is supplied to the pixel PXL. Therefore, the pixel PXL generates light with the same brightness as in the first sub-period SF1 in the second sub-period SF2.

In the third sub-period SF3, the comparator 172 receives the current from the ammeter 162 and accumulates the current value. Then, the comparator 172 generates the control signal CS when the reference value stored in the storage unit 174 is equal to the accumulated current value and supplies the generated control signal CS to the timing controller 140. Here, an amount of the current accumulated in the third sub-period SF3 may be set as an area of A3 of FIG. 6. Then, the comparator 172 generates the control signal CS when the area of A3 is equal to the area of A1 and supplies the generated control signal CS to the timing controller 140.

The timing controller 140 that receives the control signal CS supplies the emission start signal ESP set to have a third width W3 (see FIG. 8) smaller than the second width W2 (see FIG. 8) to the emission driver 130. Then, the emission driver 130 supplies the emission control signals corresponding to the third width W3 (see FIG. 8) to the emission control lines E1 through En. On the other hand, the emission start signal ESP supplied in the third sub-period SF3 is set so that the pixel PXL emits light in the third period T3.

Here, the third period T3 is set to be larger than the second period T2 and is set so that the pixel PXL emits light with the same brightness as in the first period T1. That is, the third period T3 is set so that the same current as in the first period T1 is supplied to the pixel PXL. Therefore, the pixel PXL generates light with the same brightness as in the first sub-period SF1 in the third sub-period SF3.

In the fourth sub-period SF4, the comparator 172 receives the current from the ammeter 162 and accumulates the current value. Then, the comparator 172 generates the control signal CS when the reference value stored in the storage unit 174 is equal to the accumulated current value and supplies the generated control signal CS to the timing controller 140. Here, an amount of the current accumulated in the fourth sub-period SF4 may be set as an area of A4 of FIG. 6. Then, the comparator 172 generates the control signal CS when the area of A4 is equal to the area of A1 and supplies the generated control signal CS to the timing controller 140.

The timing controller 140 that receives the control signal CS supplies the emission start signal ESP set to have a fourth width W4 (see FIG. 8) smaller than the third width W3 (see FIG. 8) to the emission driver 130. Then, the emission driver 130 supplies the emission control signals corresponding to the fourth width W4 (see FIG. 8) to the emission control lines E1 through En.

Here, the fourth period T4 is set to be larger than the third period T3 and is set so that the pixel PXL emits light with the same brightness as in the first period T1. That is, the fourth period T4 is set so that the same current as in the first period T1 is supplied to the pixel PXL. Therefore, the pixel PXL generates light with the same brightness as in the first sub-period SF1 in the fourth sub-period SF4.

As described above, when the brightness components of the pixels PXL are set to be the same in the first, second, third, and fourth sub-periods SF1, SF2, SF3, and SF4, the difference in brightness between the frames is not recognized by the user so that it is possible to improve the display quality.

On the other hand, it is described above that light components with the same brightness are generated by the pixels PXL in the first, second, third, and fourth sub-periods SF1, SF2, SF3, and SF4, which is only ideal. Actually, the brightness components of the pixels PXL may not be set to be the same but may be set to be similar to each other in the first, second, third, and fourth sub-periods SF1, SF2, SF3, and SF4 due to various conditions (wiring line resistance, noise, etc.). However, since the emission time of the pixel PXL is basically determined by the current value (the same current value) accumulated in the first, second, third, and fourth sub-periods SF1, SF2, SF3, and SF4, although the brightness of the pixel PXL slightly varies in each of the first, second, third, and fourth sub-periods SF1, SF2, SF3, and SF4, the user may not recognize the brightness difference.

Figure 7B:
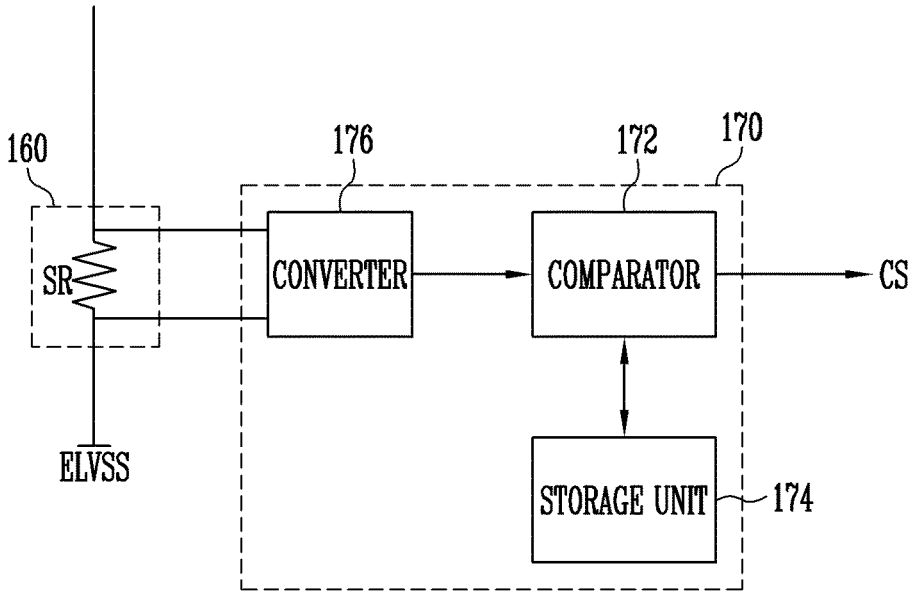
FIG. 7B is a view illustrating another exemplary embodiment of the controller of FIG. 1.

FIG. 7B is a view illustrating another exemplary embodiment of the controller of FIG. 1. FIG. 7B illustrates that the sensing unit 160 includes the sensing resistor SR. In FIG. 7B, the same elements as those of FIG. 7A are denoted by the same reference numerals and detailed description thereof will not be given.

Referring to FIG. 7B, the controller 170 according to the exemplary embodiment includes a converter 176, a comparator 172, and a storage unit 174.

The converter 176 converts a voltage value applied to the sensing resistor SR into a current value and supplies the converted current value to the comparator 172. That is, a configuration of the controller 170 according to another exemplary embodiment is the same as the controller 170 of FIG. 7A excluding that the controller 170 according to another exemplary embodiment further includes the converter 176 for converting the voltage into the current. Therefore, detailed description thereof will not be given.

Figure 9:
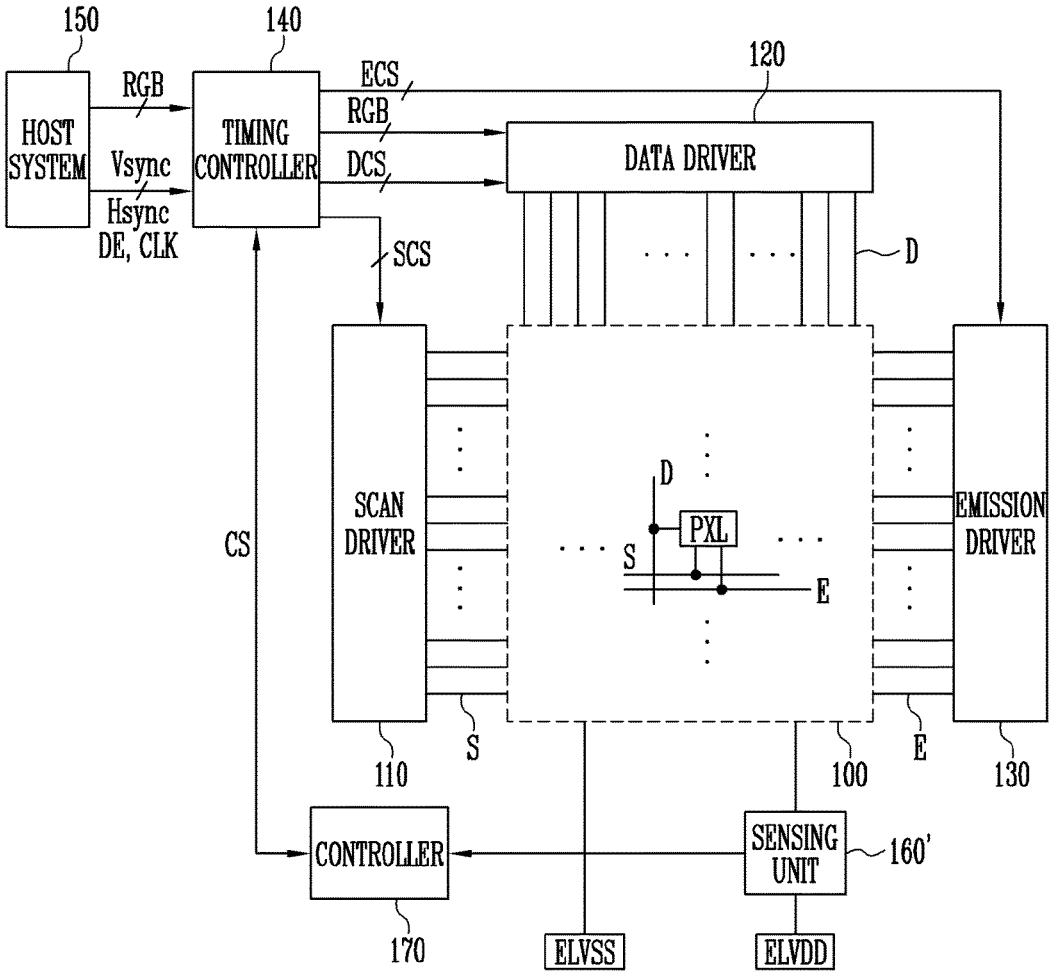
FIG. 9 is a view illustrating an organic light emitting display device according to another exemplary embodiment.

FIG. 9 is a view illustrating an organic light emitting display device according to another exemplary embodiment. In FIG. 9, the same elements as those of FIG. 1 are denoted by the same reference numerals and detailed description thereof will not be given.

Referring to FIG. 9, the organic light emitting display device according to another exemplary embodiment includes a sensing unit 160' connected between the pixels PXL and the first driving power source ELVDD. The sensing unit 160' senses currents and/or voltages between the first driving power source ELVDD and the pixels PXL and supplies the sensed currents and/or voltages to the controller 170.

Here, the sensing unit 160' is configured to include the ammeter 162 or the sensing resistor SR as illustrated in FIGS. 5A and 5B. That is, operation processes of the organic light emitting display device according to another exemplary embodiment are the same as those of the organic light emitting display device of FIG. 1 excluding that the sensing unit 160' is positioned between the first driving power source ELVDD and the pixels PXL.

In the organic light emitting display device and the method of driving the same according to the exemplary embodiment, one frame is divided into a plurality of sub-periods when the organic light emitting display device is driven at a low frequency. Here, emission periods of pixels are controlled so that light components with the same brightness may be generated in the plurality of sub-periods. Therefore, it is possible to prevent a flicker phenomenon from occurring.

Although certain embodiments and implementations have been described herein, other embodiments and modifications will be apparent from this description. Accordingly, the inventive concepts are not limited to such embodiments, but rather to the broader scope of the presented claims and various obvious modifications and equivalent arrangements.

What is claimed is:

1. An organic light emitting display device, comprising:

pixels connected to scan lines, data lines, and emission control lines and configured to emit light in response to amounts of current that flow from a first driving power source to a second driving power source;

a sensing unit connected between the first driving power source and the pixels or between the second driving power source and the pixels and configured to measure at least one of current and voltage;

a controller configured to generate a control signal in response to at least one of the current and the voltage measured by the sensing unit;

a timing controller configured to supply a plurality of emission start signals with different widths in a single frame period in response to the control signal when the organic light emitting display device is driven at a low frequency; and an emission driver configured to supply emission control signals to the emission control lines in response to the emission start signals, wherein, when the organic light emitting display device is driven at the low frequency, the single frame period is divided into a plurality of sub-periods with a same width and emission periods of the pixels in the plurality of sub-periods are set to be different from each other in response to the different widths of the emission start signals, wherein the sensing unit further comprises an ammeter configured to measure the amounts of the current, and wherein the controller comprises:

a comparator configured to accumulate the amounts of the current from the sensing unit in an emission period of a first one of the plurality of sub-periods in the single frame period, to store the accumulated amounts of the current as a reference value, and to generate the control signal when the reference value is equal to the amounts of the current measured by the sensing unit in other sub-periods of the plurality of sub-periods; and a storage unit configured to store the reference value.

2. The organic light emitting display device of claim 1, wherein the different widths of the emission start signals are set so that the emission periods of the pixels increase from a first one of the plurality of sub-periods toward a last one of the plurality of sub-periods.

3. The organic light emitting display device of claim 1, wherein the emission period of the first one of the plurality of sub-periods is previously set to be no more than 80% of the first one of the plurality of sub-periods and emission periods of the other sub-periods of the plurality of sub-periods are set in response to the control signal.

4. An organic light emitting display device, comprising:

pixels connected to scan lines, data lines, and emission control lines and configured to emit light in response to amounts of current that flow from a first driving power source to a second driving power source;

a sensing unit connected between the first driving power source and the pixels or between the second driving power source and the pixels and configured to measure at least one of current and voltage;

a controller configured to generate a control signal in response to at least one of the current and the voltage measured by the sensing unit;

a timing controller configured to supply a plurality of emission start signals with different widths in a single frame period in response to the control signal when the organic light emitting display device is driven at a low frequency; and an emission driver configured to supply emission control signals to the emission control lines in response to the emission start signals, wherein, when the organic light emitting display device is driven at the low frequency, the single frame period is divided into a plurality of sub-periods with a same width and emission periods of the pixels in the plurality of sub-periods are set to be different from each other in response to the different widths of the emission start signals, wherein the sensing unit comprises a sensing resistor, and wherein the controller comprises:

a converter configured to convert voltage values from the sensing resistor into current values;

a comparator configured to accumulate the current values from the converter in an emission period of a first one of the plurality of sub-periods in the single frame period, to store the accumulated current values as a reference value, and to generate the control signal when the reference value is equal to the current values from the converter in other sub-periods of the plurality of sub-periods; and a storage unit configured to store the reference value.

5. The organic light emitting display device of claim 4, wherein the emission period of the first one of the plurality of sub-periods is previously set to be no more than 80% of the first one of the plurality of sub-periods and emission periods of the other sub-periods of the plurality of sub-periods are set in response to the control signal.

6. The organic light emitting display device of claim 4, wherein the different widths of the emission start signals are set so that the emission periods of the pixels increase from a first one of the plurality of sub-periods toward a last one of the plurality of sub-periods.

7. A method of driving an organic light emitting display device driven so that a single frame period is divided into a plurality of sub-periods, the method comprising:

accumulating amounts of current that flow to pixels in an emission period of a first one of the plurality of sub-periods; and controlling emission periods of the pixels so that amounts of current that flow to the pixels in remaining sub-periods of the plurality of sub-periods excluding the first sub-period are same as the amounts of current accumulated in the first one of the plurality of sub-periods.

8. The method of claim 7, wherein, when the first one of the plurality of sub-periods is set as a predetermined period, the emission period of the first one of the plurality of sub-periods is set to be no more than 80% of the predetermined period.

9. The method of claim 7, wherein emission periods of the pixels are set to increase from the first one of the plurality of sub-periods toward a last one of the plurality of sub-periods.

10. The method of claim 7, wherein the pixels maintain data signals supplied in the first one of the plurality of sub-periods in remaining sub-periods of the plurality of sub-periods.

* * * * *